US006590987B2

(12) United States Patent
Delage

(10) Patent No.: US 6,590,987 B2
(45) Date of Patent: Jul. 8, 2003

(54) TWO-WIRED HEARING AID SYSTEM UTILIZING TWO-WAY COMMUNICATION FOR PROGRAMMING

(75) Inventor: David J. Delage, Idaho Falls, ID (US)

(73) Assignee: Etymotic Research, Inc., Elk Grove Village, IL (US)

( * ) Notice: Subject to any disclaimer, the term of this patent is extended or adjusted under 35 U.S.C. 154(b) by 308 days.

(21) Appl. No.: 09/764,842

(22) Filed: Jan. 17, 2001

(65) Prior Publication Data

US 2002/0094098 A1 Jul. 18, 2002

(51) Int. Cl.[7] ..... H04R 25/00
(52) U.S. Cl. ..... 381/315; 381/314
(58) Field of Search ..... 381/312, 314, 381/315, 323; 330/261, 159, 297

(56) References Cited

U.S. PATENT DOCUMENTS 4,509,022 A * 4/1985 Ridel ..... 330/284
4,689,819 A * 8/1987 Killion
4,951,002 A * 8/1990 Hanon
4,961,230 A * 10/1990 Rising
6,366,676 B1 * 4/2002 Neilson

* cited by examiner

*Primary Examiner*—Sinh Tran
(74) *Attorney, Agent, or Firm*—McAndrews, Held & Malloy, Ltd.

(57) ABSTRACT

A hearing aid system is disclosed that enables a two-wire configuration for power, data and ground, and two-way communication between a hearing aid and an external programming device or system. In one embodiment, the hearing aid includes a receiver and a bypass capacitor, such as commonly found with Class D receivers. Circuitry is included that switches between a normal hearing aid operating mode in which the bypass capacitor is connected, and a programming mode in which at least the bypass capacitor is disconnected. Switching may occur in response to the input voltage of the hearing aid rising above and falling below a predetermined threshold. The hearing aid may operate using three different voltages, one for normal operation and two others representative of logic signals during the programming mode.

27 Claims, 2 Drawing Sheets

TWO-WIRED HEARING AID SYSTEM UTILIZING TWO-WAY COMMUNICATION FOR PROGRAMMING

CROSS-REFERENCE TO RELATED APPLICATIONS

N/A

STATEMENT REGARDING FEDERALLY SPONSORED RESEARCH OR DEVELOPMENT

N/A

BACKGROUND OF THE INVENTION

Hearing aids, at their most basic level, may be described as amplifiers with adjustments (e.g. volume, tone, MPO). For conventional hearing aids these adjustments are often made with trimmers (very small variable resistors). Alternatively, because of size limitations, the hearing aid manufacturer often presets the adjustments. In any case, as hearing aids become ever smaller and as the number of possible adjustments increases due to AGC, multi-band circuitry and other enhancements, it has become nearly impossible to fit all the required adjustments in a hearing aid that will be of a size acceptable to the patient.

In an attempt to solve this problem, programmable hearing aids were developed. Originally, programmable hearing aids were analog hearing aids with "digital trimmers." In other words, early programmable hearing aids had some form of trimmer that could be controlled by some form of memory that could be programmed by some external apparatus. While there are substantial differences in circuitry between the earlier "programmable analog" hearing aids and the later "true digital" hearing aids, both of them require "programming" and will be considered together under the name "programmable hearing aid".

Programming a programmable hearing aid generally involves two-way communication. Specifically, a programming system enables the reading of the current settings of the hearing aid as well as the writing of new settings to the hearing aid. Other schemes have been employed involving one-way communication, such as, for example, radio frequency, optical or acoustic programming, but to date have been mostly used for changing a hearing aid's settings from one previously programmed condition to an alternate previously programmed condition.

Wired programming has existed in many forms from a high of five wires to a low of two. The most common current system was invented by Starkey and uses 3 wires (Ground, Power and Data). In this system, the data line is controlled primarily by the hearing aid in a six segment per bit protocol. It is the programming instrument's responsibility to adapt, within limits, to the timing of the hearing aid. An example of a circuit using this protocol is Etymotic Research ER-102 Digital ScrewDriver. The main disadvantage of a three-wire system is that a connector is required. In the ever-smaller hearing aid, a connector, no matter how small, is still a mechanical disadvantage. It is also a cost disadvantage.

One solution to this problem has been developed and is being marketed by RTI. RTI's solution is to modify the faceplate battery drawer from a two-wire configuration to a four-wire configuration. They then provide appropriately sized "battery pills' that mate with the modified battery drawer. This solves the mechanical problem posed by an additional connector on the faceplate. However, the multi-wire battery pill is inherently fragile. It is necessary to remove the battery door in order to insert the battery pill.

A two-wire protocol, using a conventional battery pill is desirable for many reasons. For example, two-wire battery pills are much more rugged, do not require battery door removal, are widely available, match faceplates from all manufacturers and require no additional wiring in the hearing aid from the faceplate to the circuit.

A two-wire protocol was created by ReSound and exists in the public domain but has found little favor. In the ReSound protocol, information is sent to the hearing aid by the programming instrument using voltage pulses (from 1.25 to 2.50 Volts). Information is sent to the programming instrument from the hearing aid using current pulses (additional 1 mA drain). The protocol is a pulse width modulated scheme operating at 1 kHz. "0's" are sent $1/3^{rd}$ high and $2/3^{rd}$ low. "1's" are sent $2/3^{rd}$ high and $1/3^{rd}$ low. This system has several disadvantages. First, it has no synchronization capability. This requires that the frequency of the hearing aid and the frequency of the programming instrument be very closely matched. Such requirement forces the hearing aid to be more complex, and therefore both more costly and larger. A second and far more important disadvantage is that the system can only work with Class B receivers and not with the more common Class D receivers. More specifically, Class D receivers require a 2.2 uF bypass capacitor across their power supply terminals, and Class B receivers do not. This bypass capacitor alone requires that the programming instrument source/sink in excess of 25 mA in order to send data at the relatively slow 1 kHz rate. Currently, common programming instruments are not capable of doing that.

Further limitations and disadvantages of conventional and traditional systems will become apparent to one of skill in the art through comparison of such systems with the present invention as set forth in the remainder of the present application with reference to the drawings.

BRIEF SUMMARY OF THE INVENTION

These and other problems in the prior art are addressed by the hearing aid of the present invention, which in one embodiment, generally comprises a receiver and a bypass capacitor (such as commonly found with Class D receivers). Circuitry is included that disconnects the bypass capacitor and, if desired, other hearing aid components during a hearing aid programming operation. The circuitry also reconnects the bypass capacitor (and other hearing aid components, if disconnected) after the hearing aid programming operation. In other words, the circuitry switches between a normal hearing aid operating mode in which the bypass capacitor is connected and a programming mode in which the bypass capacitor is disconnected.

In one embodiment, the circuitry includes a comparator and a switch. The switch is opened and closed in response to the input voltage rising above and falling below a predetermined threshold value, which may be, for example, 1.5 volts. When the input voltage is below the threshold value, the hearing aid operates in a normal manner at a first voltage, such as, for example 1.25 volts. When the input voltage is above the threshold value, the hearing aid operates in a programming mode. In the programming mode, the hearing aid receives logic data from a programmer at second and third voltages, which may be, for example, approximately 1.6 and 2.5 volts, respectively. In other words, the hearing aid of the present invention uses three voltage levels for operation in both the normal and programming modes, namely, one for normal operation, a second for logic low signals and a third for logic high signals.

The present invention enables use of a two-wire configuration and two-way communication for programmable hearing aids having non-Class B receivers, as well as faster transmission rates.

In addition, the circuitry of the present invention further utilizes a protocol that enables an external programmer (i.e., programming device or system) to automatically determine and track the hearing aid data transfer rate as well as the make and model of the hearing aid.

Other aspects, advantages and novel features of the present invention will become apparent from the following detailed description of the invention when considered in conjunction with the accompanying drawings.

DETAILED DESCRIPTION OF THE INVENTION

Figure 1:
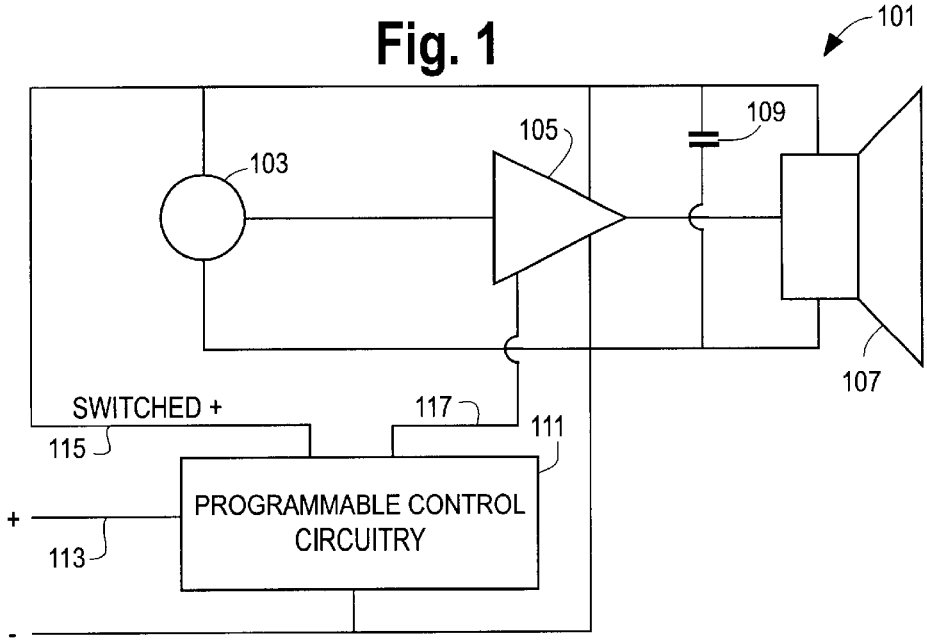
FIG. 1 is a block diagram of a hearing aid system according to the present invention.

FIG. 1 is a block diagram of a hearing aid system according to the present invention. Hearing aid 101 comprises a hearing aid microphone 103, a hearing aid amplifier 105 and a hearing aid receiver or speaker 107. The hearing aid 101 also comprises a bypass capacitor 109, such as, for example, that used in conjunction with Class D receivers, as well as programmable control circuitry 111. Programmable control circuitry 111 includes an input/output 113 for receiving power signals from a hearing aid programmer in a programming mode or from a hearing aid battery in a normal operation mode (both the programmer and battery not shown in FIG. 1). The programmable control circuitry 111 also includes a switched+output 115 which causes at least the bypass capacitor 109 (and, if desired, the receiver or speaker 107) to be switched out of the circuit during a programming operation. The programmable control circuitry 111 further includes a hearing aid control output 117 for adjusting the hearing aid settings during the programming operation. Output 117 may be a multi-control type output.

In operation, depending on the signal at input/output 113, the hearing aid 101 operates in a normal hearing aid mode or in a programming mode. More specifically, if a first signal representative of a battery is sensed at input 113, then the switched+output 115 causes the capacitor 109 to be connected in the circuit, and hearing aid 101 operates in a normal hearing aid mode. If a second signal representative of a hearing aid programmer is sensed at input/output 113, then the switched+output 115 causes at least the capacitor 109 to be disconnected from the circuit, and hearing aid 101 operates in a programming mode. In the programming mode, control signals received at input/output 113 are used by the programmable control circuitry 111 to adjust the hearing aid settings via control output 117. Hearing aid amplifier circuitry 101 may be analog and/or digital.

Unlike the prior art, the hearing aid system of FIG. 1 enables two-wire, two-way communication for programming hearing aids having non-Class B receivers.

Figure 2:
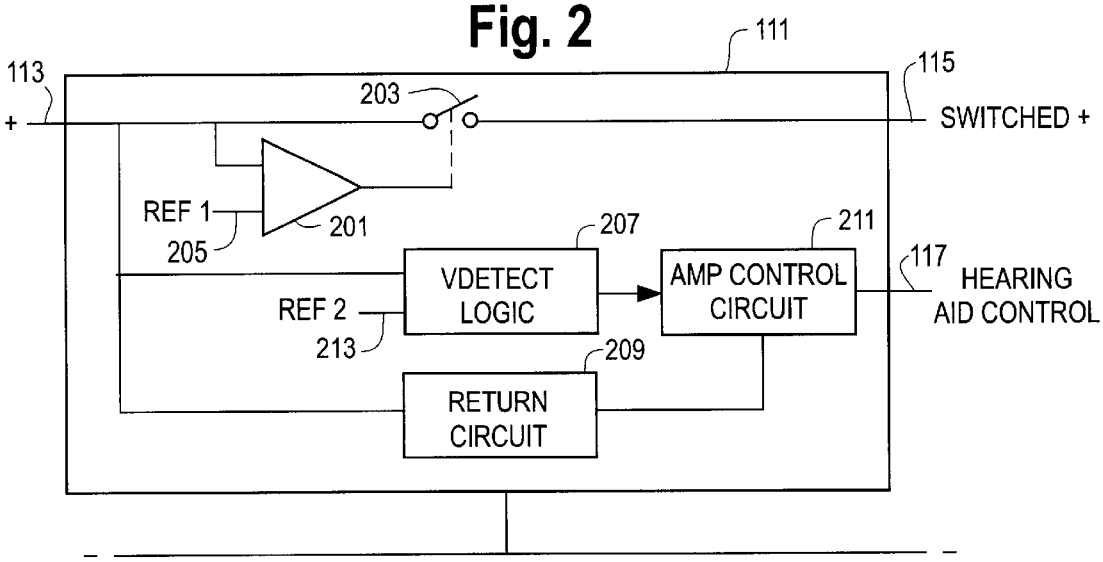
FIG. 2 is a block diagram of one embodiment of the programmable control circuitry of FIG. 1.

FIG. 2 is a block diagram of one embodiment of the programmable control circuitry 111 of FIG. 1. In the embodiment of FIG. 2, programmable control circuitry 111 comprises a comparator 201 operatively connected to input/output 113 and to a switch 203. The comparator 201 compares the voltage at input 113 to a reference voltage 205, and then, depending on the result, opens or closes switch 203. Switch 203 is connected to the switched+output 115 for including or excluding at least a capacitor, for example, in or from the circuit as discussed above with reference to FIG. 1.

The embodiment of programmable control circuitry 111 found in FIG. 2 further comprises VDetect logic 207 operatively connected to input/output 113, a return circuit 209 and an amp control circuit 211. Amp control circuit 211 is connected to the hearing aid control output 117. VDetect logic 207 provides logic detection and translation. VDetect logic 207 compares the voltage at input/output 113 to a reference voltage 213, and, depending on the result, controls the amp control circuit 211 (which adjusts the hearing aid settings) or does nothing (indicative of a normal hearing aid mode). The amp control circuit 211 is hearing aid dependent. The return circuit 209 is enabled by VDetect logic 207, receives data signals from the amp control circuit 211, and sends the data back down line (i.e., out to the programmer via input/output 113) using current pulses pursuant to a predefined protocol (e.g., arbitration, speed sharing, pulse width modulation, etc.).

In operation of the embodiment of FIG. 2, the signal at input/output 113 may be a pulse width modulated signal from approximately 1.25 to 2.5 volts, for example. A signal of 1.25 volts may be used to operate the hearing aid. When the voltage at input/output 113 is less than reference voltage 205, which may be, for example, 1.5 volts, the hearing aid operates normally. When the voltage at input/output 113 is greater than the reference voltage 205 (e.g., greater than 1.5 volts), the switch 203 is opened.

At the same time, the signal at input/output 113 is compared to reference voltage 213, which may be, for example, 2.0 volts. If the signal at input/output 113 is greater than the reference voltage 213, a logical high or "1" is output from VDetect logic 207. If the signal at input/output 113 is less than the reference voltage 213 but greater than the reference voltage 205, such as, for example, 1.6 volts, a logical low or "0" is output from the VDetect logic 207. In this manner, clock synchronous highs and lows are transmitted from the VDetect logic 207 to control the amp control circuit 211.

As mentioned above, the return circuit 209 is enabled by the VDetect logic 207, and receives data from the amp control circuit 211. The amp control circuit 211 in turn sends the data back to the programmer (not shown) via input/output 113 using current pulses pursuant to a predefined protocol.

Figure 3:
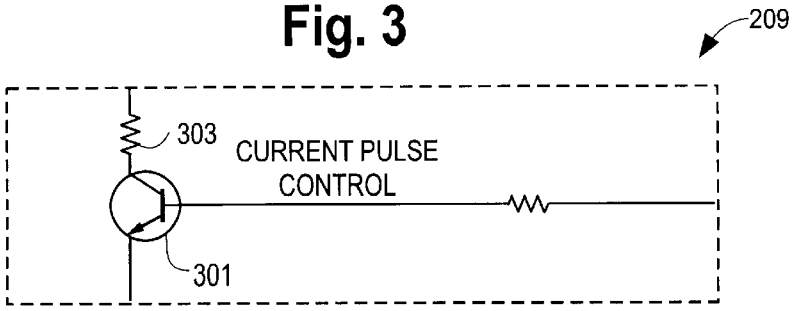
FIG. 3 illustrates one embodiment of the return circuit of FIG. 2.

FIG. 3 illustrates one embodiment of the return circuit 209 of FIG. 2. The return circuit 209 of FIG. 3 comprises an npn transistor 301 in conjunction with a resistor 303. The base of transistor 301 is connected to amp control circuit 211 of FIG. 2. The emitter of transistor 301 is connected to ground, and the collector of transistor 301 is connected, through resistor 303, to input/output 113 of FIG. 2. Resistor 303 may have a value of 2.5 kΩ, for example. The configuration of FIG. 3 enables current pulse communication of data from the amp control circuit 211 to the hearing aid programmer (not shown).

In the embodiment of FIG. 2, the hearing aid system uses three voltage levels, while the prior art discussed above uses two voltage levels. More specifically, the prior art two-wire system of Resound mentioned above uses 1.25 volts to operate the hearing aid as well as to indicate logic 0, and uses 2.5 volts to indicate logic 1. In one embodiment of the system of FIG. 2, 1.25 volts is used to operate the hearing aid, but logic 0 is set somewhere above 1.25 volts, such as, for example, 1.6 volts. Logic 1 is set at 2.5 volts, for example.

Also, as mentioned above, the embodiment of FIG. 2 includes some additional functionality not found in the prior art discussed above. For example, the system detects the voltage change and, when 1.6 volts, for example, is detected, it opens a switch in the power supply to at least the capacitor. In one embodiment, both the receiver and its bypass capacitor are disconnected, thereby eliminating the need for large current compliance in the programmer. This has the additional benefit of muting the hearing aid during programming. Further, it is contemplated by the present invention that the amplifier also be disconnected, which would reduce the current draw and allow for a corresponding increase in programming speed.

Figure 4:
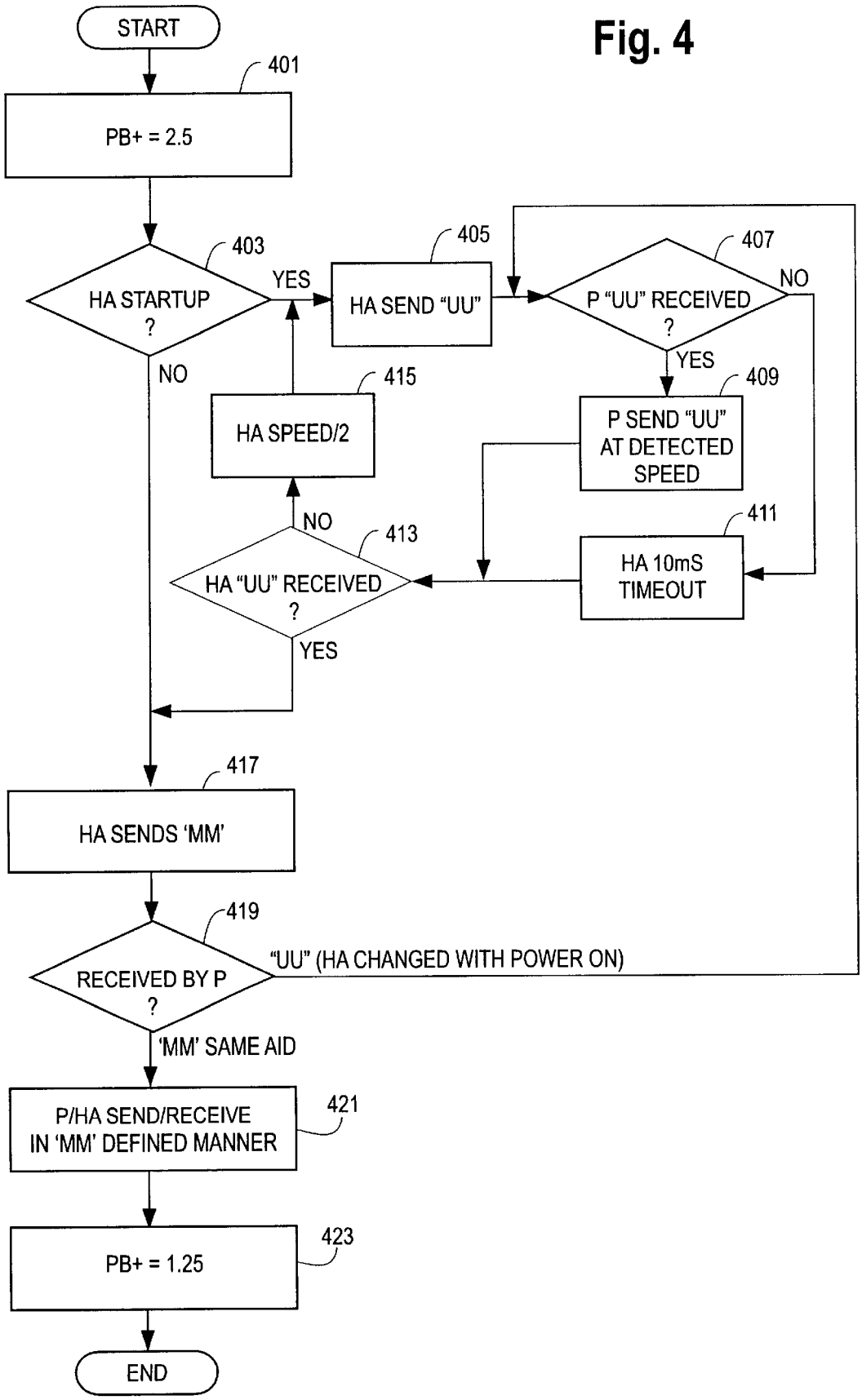
FIG. 4 is a handshake logic flow diagram of one embodiment of a two-wire protocol that may be used by the hearing aid system of the present invention.

FIG. 4 is a handshake logic flow diagram of one embodiment of a two-wire protocol that may be used by the system of the present invention. The programmer initially raises the voltage to 2.5 volts (block 401), which disconnects the receiver, capacitor and amplifier, for example. The hearing aid starts pulling current pulses that are used by the programmer to determine the RC oscillator timing in the hearing aid and the startup status of the hearing aid (block 403). If at block 403 this is the first transmission from the hearing aid since power was applied, the hearing aid initially sends a "UU" to the programmer (block 405). This pattern of 8 "0's" interleaved with 8 "1's" communicates both the clock speed of the hearing aid and the fact that the hearing aid is being addressed for the first time. If at block 407 the programmer receives the "UU," it returns "UU" to the hearing aid at the detected clock speed, signaling success (block 409).

If, however, at block 407 the programmer does not receive the "UU" from the hearing aid, the hearing aid takes a 10 mS timeout, for example, to wait for the programmer to acknowledge receipt of the "UU" (block 411). If at block 413, the hearing aid does not receive the "UU" acknowledgement from the programmer, the clock speed is reduced (for example, by ½) (block 415), and the hearing aid resends the "UU" at block 405. Non-detection by the programmer of the initial "UU" from the hearing aid may be due to excess cable capacity, a slow programmer or other external factors.

Once the hearing aid receives acknowledgement from the programmer at block 413 (i.e., synchronization has been achieved), or in the case when at block 403 it is not the first transmission since power was applied, the hearing aid returns "MM" (block 417), a 16 bit sequence indicating the hearing aid manufacturer and model, to the programmer. If the "MM" is not received by the programmer at block 419 and a "UU" or an undecipherable message is received when not expected, then the programmer returns to block 407 to interpret the information received and the process is repeated.

If instead at block 419, the "MM" is in fact received by the programmer, the programmer recognizes that the hearing aid is the same, and proceeds to program the hearing aid according to the "MM" code (block 421). In other words, for block 421, the programming sequence is under the control of the manufacturer for the particular "MM" code, which may vary by model. "MM" may consist of a 9 bit manufacturer code and a 7 bit model code. Since the 16 bit "UU" code is not available, the protocol of the present invention allows for 511 manufacturers with 128 models each and a $512^{th}$ manufacturer with 127 models.

Finally, at block 423, the voltage is lowered to the hearing aid operating level of 1.25 volts.

In the case when nothing (i.e., no "MM") is received from the hearing aid (e.g., a cord is disconnected, the hearing aid is shut off, etc.), the programmer may time out and display an error message (sequence not shown in FIG. 4).

As is apparent from FIG. 4, the programmer captures the clock rate in the initial sequence. This enables automatic correction if the "MM" is received at a slightly different clock rate due to drift or component variation in the hearing aid. In addition, as is also apparent from FIG. 4, if the hearing aid is changed with the power on (i.e., "UU" is received when not expected), the new hearing aid and clock rate will automatically be detected.

With reference to FIGS. 2–4, in one exemplary embodiment, the hearing aid turns on the switched circuitry for any voltage below 1.45 and turns off the switched circuitry for any voltage greater than 1.55. From the programmer, the data is sent as a pulse width modulated voltage between 2.5 and 1.6. The hearing aid detects a "high" for any voltage greater than 2.1 and a "low" for any voltage less than 2.0.

From the hearing aid, the data is sent as pulse width modulated current between 1.0 and 0.0 mAa, where mAa is milliamperes of additional current in excess of the steady state current of the hearing aid circuit. The programmer detects a "high" for any mAa greater than 0.6 and a "low" for any mAa less than 0.4.

A bit "frame" begins on a high to low transition and ends on a high to low transition. The ending high to low transition may not occur on the last bit sent and is not needed. A "1" is sent by a low pulse for one-third the frame rate followed by a high pulse for two-thirds the frame rate. A "0" is sent by a low pulse for two-thirds the frame rate followed by a high pulse for one-third the frame rate. Thus, measurement of the value of the pulse at one-half the frame period following the high to low transition produces the correct logic value.

The system of the present invention enables programming of hearing aids having receivers of any class and very fast transmission rates (e.g., 100 $\mu$S/bit). In addition, the system of the present invention permits the use of a simple and low cost R/C oscillator in the hearing aid, any faceplate, and lower cost, more rugged two-wire battery pills. Finally, the system of the present invention provides the hearing aid manufacturer with complete flexibility in the programming of the hearing aid circuit.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. A programmable hearing aid comprising:

a microphone;

an amplifier;

a receiver;

a bypass capacitor connected across the receiver; and circuitry for disconnecting at least one load and the bypass capacitor during a hearing aid programming operation, and for reconnecting the at least one load and the bypass capacitor after the hearing aid programming operation.

2. The programmable hearing aid of claim 1 wherein the circuitry comprises a comparator and a switch.

3. The programmable hearing aid of claim 2 wherein the switch is opened to disconnect the at least one load and the bypass capacitor in response to an input voltage rising above a predetermined threshold.

4. The programmable hearing aid of claim 3 wherein the predetermined threshold is approximately 1.5 volts.

5. The programmable hearing aid of claim 3 wherein the switch is closed to reconnect the at least one load and the bypass capacitor in response to the input voltage falling below the predetermined threshold.

6. The programmable hearing aid of claim 1 further comprising a single wire for providing power to the microphone, amplifier, receiver, bypass capacitor and circuitry, and for communicating data signals between the hearing aid and an external programmer during the programming operation.

7. The programmable hearing aid of claim 1 further comprising only two wires for providing power to the hearing aid, for providing two-way communication between the hearing aid and an external programmer, and for ground.

8. The programmable hearing aid of claim 1 wherein the circuitry enables automatic determination by an external programmer of at least one of the hearing aid data transfer speed and the hearing aid make and model.

9. The programmable hearing aid of claim 1 wherein the hearing aid operates in a normal mode when an input voltage is in a range about a first voltage level, and during the programming operation, receives a first logic signal when the input voltage is in a range about a second voltage level and a second logic signal when the input voltage is in a range about a third voltage level.

10. The programmable hearing aid of claim 9 wherein the circuitry disconnects the at least one load and the bypass capacitor when an input voltage rises above a fourth voltage level.

11. The programmable hearing aid of claim 10 wherein the first voltage level is approximately 1.25 volts, the second voltage level is approximately 1.6 volts, the third voltage level is approximately 2.5 volts and the fourth voltage level is approximately 1.5 volts.

12. The programmable hearing aid of claim 1 wherein the at least one load comprises the receiver.

13. A programmable hearing aid comprising:

a microphone;

an amplifier;

a receiver;

a bypass capacitor connected across the receiver; and circuitry for switching between a hearing aid operating mode in which at least one load and the bypass capacitor are connected and a hearing aid programming mode in which at least the bypass capacitor is disconnected.

14. The programmable hearing aid of claim 13 wherein both the bypass capacitor and the at least one load are disconnected during the programming mode.

15. The programmable hearing aid of claim 13 wherein switching from the hearing aid operating mode to the hearing aid programming mode is responsive to an input voltage rising above a predetermined threshold, and switching from the programming mode to the operating mode is responsive to the input voltage falling below the predetermined threshold.

16. The programmable hearing aid of claim 15 wherein the predetermined threshold is approximately 1.5 volts.

17. The programmable hearing aid of claim 13 further comprising a single wire for providing power to the microphone, amplifier, receiver, bypass capacitor and circuitry, and for communicating data between the hearing aid and an external programmer during the programming mode.

18. The programmable hearing aid of claim 13 further comprising only two wires for providing power to the hearing aid, for providing two-way communication between the hearing aid and an external programmer, and for ground.

19. The programmable hearing aid of claim 13 wherein the circuitry enables automatic determination by an external programmer of at least one of the hearing aid data transfer speed and the hearing aid make and model.

20. The programmable hearing aid of claim 13 wherein the hearing aid is in the operating mode when an input voltage is in a range about a first voltage level, and is in the programming mode when the input voltage is above the first voltage level.

21. The programmable hearing aid of claim 20 wherein the hearing aid receives a first logic signal when the input voltage is in a range about a second voltage level and a second logic signal when the input voltage is in a range about a third voltage level.

22. The programmable hearing aid of claim 21 wherein the first voltage level is approximately 1.25 volts, the second voltage level is approximately 1.6 volts, and the third voltage level is approximately 2.5 volts.

23. The programmable hearing aid of claim 13 wherein the at lest one load comprises the receiver.

24. A method of operating a programmable hearing aid comprising:

providing power to a hearing aid microphone, amplifier, receiver, and bypass capacitor;

detecting an input voltage;

shutting off power to at least the bypass capacitor when the detected input voltage is above a predetermined threshold;

recognizing a first logic signal when the detected input voltage is at a first voltage level greater than the predetermined threshold;

recognizing a second logic signal when the detected input voltage is at a second voltage level greater than the predetermined threshold and the first voltage level; and restoring power to the at least bypass capacitor when the detected input voltage falls below the predetermined threshold.

25. A method of operating a programmable hearing aid comprising:

providing power to a hearing aid receiver and bypass capacitor;

detecting an input voltage;

shutting off power to at least the bypass capacitor when the detected input voltage rises above a predetermined threshold; and performing a programming operation when the detected input voltage is above the predetermined threshold.

26. The method of claim 25 further comprising restoring power to the at least bypass capacitor when the detected input voltage falls below the predetermined threshold.

27. The method of claim 26 further comprising performing normal hearing aid operation when the detected input voltage is below the predetermined threshold.

* * * * *